US008439652B2

(12) United States Patent
Hayashi et al.

(10) Patent No.: US 8,439,652 B2
(45) Date of Patent: May 14, 2013

(54) SUCTION THROTTLE VALVE FOR VARIABLE DISPLACEMENT TYPE COMPRESSOR

(75) Inventors: Shiro Hayashi, Kariya (JP); Taro Ozeki, Kariya (JP); Mitsunori Yoshida, Kariya (JP); Toshiyuki Miyano, Kariya (JP); Sokichi Hibino, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 1136 days.

(21) Appl. No.: 12/070,276

(22) Filed: Feb. 14, 2008

(65) Prior Publication Data

US 2008/0199328 A1 Aug. 21, 2008

(30) Foreign Application Priority Data

Feb. 16, 2007 (JP) ..... 2007-035567

(51) Int. Cl.
*F04B 49/22* (2006.01)

(52) U.S. Cl.
USPC ..... 417/295; 417/222.2; 417/270; 417/298

(58) Field of Classification Search ..... 417/222.2, 417/269, 270, 295, 298
See application file for complete search history.

(56) References Cited

U.S. PATENT DOCUMENTS

| | | | | |
|---|---|---|---|---|
| 5,785,502 | A * | 7/1998 | Ota et al. | 417/222.2 |
| 6,257,848 | B1 | 7/2001 | Terauchi | 417/441 |
| 2005/0244279 | A1 | 11/2005 | Murakami et al. | 417/222.2 |
| 2006/0165535 | A1 | 7/2006 | Ota et al. | 417/222.2 |

FOREIGN PATENT DOCUMENTS

| | | |
|---|---|---|
| JP | 04-22071 | 5/1992 |
| JP | 2000-136776 | 5/2000 |

* cited by examiner

*Primary Examiner* — Charles Freay
*Assistant Examiner* — Philip Stimpert
(74) *Attorney, Agent, or Firm* — Locke Lord LLP

(57) ABSTRACT

A suction throttle valve of a variable displacement compressor having a compressor housing includes a suction chamber, a crank chamber, an inlet, a suction passage, a valve body, a valve housing, an urging member, a valve chamber, and a communication hole. The valve body is provided for adjusting an opening area of the suction passage and movably arranged in the suction passage. The urging member urges the valve body in the direction that decreases the opening area of the suction passage. The communication hole is provided for connecting the suction chamber to the valve housing. An opening area of the communication hole is variable in accordance with the movement of the valve body. Accordingly, the opening area of the communication hole becomes maximum during the maximum displacement operation of the compressor and becomes reduced during the intermediate displacement operation of the compressor.

12 Claims, 3 Drawing Sheets

SUCTION THROTTLE VALVE FOR VARIABLE DISPLACEMENT TYPE COMPRESSOR

BACKGROUND OF THE INVENTION

The present invention relates to a suction throttle valve of a variable displacement compressor for use, for example, in an automotive air conditioning system and, more particularly, to a suction throttle valve of a variable displacement compressor for reducing the vibration and noise development that are due to pulsation of the suction refrigerant gas.

There is generally known a variable displacement compressor which is designed for use in an automotive air conditioning system and the like and capable of variably controlling its displacement. Such variable displacement compressor will be referred to merely as a "compressor" hereinafter. The compressor often generates noise which is due to pulsation of the suction refrigerant gas produced when the compressor is operating with a low flow rate of the suction refrigerant gas. For reducing the development of such noise, some compressors use a suction throttle valve which is provided in the suction passage between the inlet and the suction chamber for changing the opening area of the suction passage in accordance with the flow rate of the suction refrigerant gas.

Japanese Patent Application Publication No. 2000-136776 discloses a compressor having this type of suction throttle valve. In the compressor of this reference, a gas passage is formed between the inlet and the suction chamber, and a valve working chamber is formed between the gas passage and the inlet. An opening control valve is vertically movably arranged in the valve working chamber. The opening control valve is urged upward by a spring accommodated in a valve chamber which is formed in the valve working chamber. The opening control valve is moved upward or downward thereby to control the opening area of the gas passage in accordance with flow rate of the suction refrigerant gas drawn into the suction chamber through the inlet. The valve chamber communicates with the suction chamber through a communication passage. The opening control valve has a hole formed therethrough.

When the flow rate of the suction refrigerant gas is high, the pressure difference between the inlet and the suction chamber is increased. Thus, the opening control valve of the compressor according to the above reference is adapted to move downward against the urging force of the spring, thereby enlarging the opening area of the gas passage. Meanwhile, when the flow rate of the suction refrigerant gas is low, the pressure difference between the inlet and the suction chamber becomes small. Thus, the opening control valve of the compressor is adapted to move upward by the urging force of the spring, thereby reducing the opening area of the gas passage. This throttling effect of the opening control valve helps to reduce the noise caused by the pulsation of the suction refrigerant gas when the flow rate of the suction refrigerant gas is low.

The valve chamber accommodating therein the spring has a damping mechanism which is operable to urge the opening control valve upward. The damper effect acting on the opening control valve varies in accordance with the gas-tightness of the valve chamber. That is, the damper effect is enhanced with an increase of the gas-tightness of the valve chamber, but reduced with a decrease of the gas-tightness. The valve chamber communicates with the suction chamber through the communication passage which has a substantially constant diameter and communicates with the inlet through the hole formed in the opening control valve. Thus, the gas-tightness of the valve chamber is not sufficiently high and, therefore, the damper effect acting on the opening control valve is not sufficiently high, with the result that the damper effect is constant regardless of the flow rate of the suction refrigerant gas.

The damper effect prevents the opening control valve from moving when the compressor is operating with a high flow rate of the suction refrigerant gas, so that sufficient opening area of the suction passage may not be accomplished. The damper effect against the pulsation of the suction refrigerant gas may not be obtained sufficiently during compressor operation with a low flow rate of the suction refrigerant gas. Therefore, the spring constant needs to be set relatively large for increasing the throttle effect during compressor operation with a low flow rate of the suction refrigerant gas. However, if the spring constant is set too large, the required opening area is not obtained because the suction passage is throttled too much during operation with a high flow rate of the suction refrigerant gas. Thus, the compressor of the above-cited Publication is unable to fulfill simultaneously the above requirements. That is, there are requirements which are to enhance the effect of throttling the suction passage during compressor operation with a low flow rate of the suction refrigerant gas and to ensure sufficient opening area of the suction passage during operation with a high flow rate of the suction refrigerant gas. Therefore, the opening control valve of the above compressor is not movable smoothly in response to the variation of the flow rate of the suction refrigerant gas. Consequently, it is difficult for the opening control valve to maintain the performance of the compressor according to the variable operating condition of the compressor.

SUMMARY OF THE INVENTION

In accordance with an aspect of the present invention, a suction throttle valve of a variable displacement compressor having a compressor housing includes a suction chamber, a crank chamber, an inlet, a suction passage, a valve body, a valve housing, an urging member, a valve chamber, and a communication hole. Suction refrigerant gas is drawn into the compressor through the inlet. The suction passage connects the inlet to the suction chamber. The valve body for adjusting an opening area of the suction passage, the valve body being movably arranged in the suction passage. The valve housing accommodates the valve body. The urging member urges the valve body in the direction that decreases the opening area of the suction passage. The valve chamber is formed in the valve housing on opposite side of the valve body with respect to the suction passage. The communication hole connects the suction chamber to the valve chamber. An opening area of the communication hole is variable in accordance with the movement of the valve body. Accordingly, the opening area of the communication hole becomes maximum during the maximum displacement operation of the compressor and the opening area of the communication hole becomes reduced during the intermediate displacement operation of the compressor.

According to the present invention, a communication passage is provided for connecting the valve chamber to the suction chamber of a compressor and the opening area of the communication passage is variable according to the movement of the valve body, thereby to effectively obtain the damper effect. Thus, the vibration and noise development caused by the suction pulsation in the compressor may be reduced during the operation with low flow rate of the suction refrigerant gas. Additionally, the performance of the compressor may be maintained over the entire displacement range or over the entire range of flow rate of the suction refrigerant gas.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
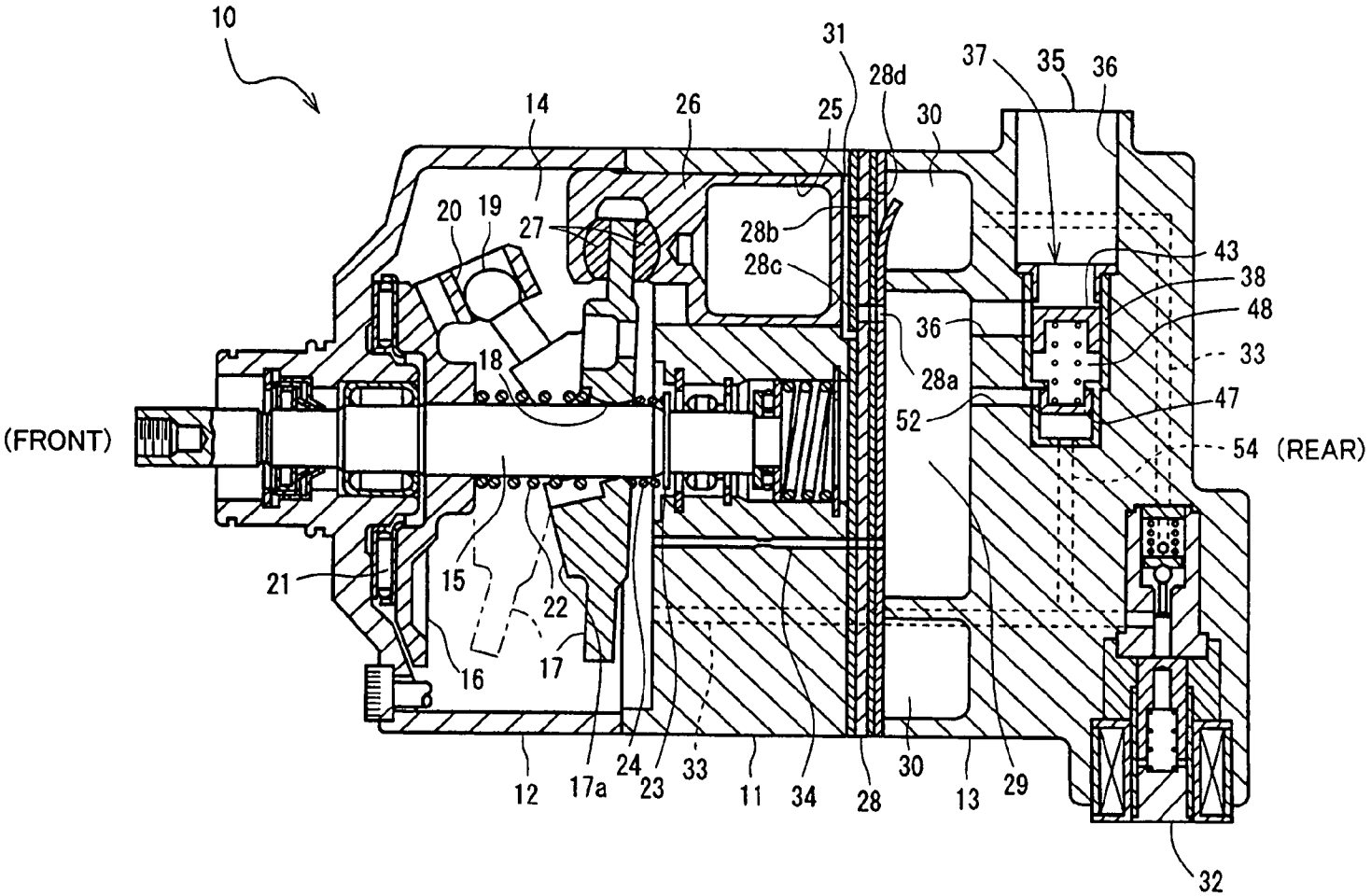
FIG. 1 is a longitudinal cross-sectional view of a variable displacement compressor according to a first preferred embodiment of the present invention.

The following will describe a swash plate type variable displacement compressor (hereinafter merely referred to as "compressor") according to the first preferred embodiment of the present invention with reference to FIGS. 1 through 3B. As shown in FIG. 1, a compressor 10 includes a cylinder block 11, a front housing 12, and a rear housing 13. The front housing 12 is joined to the front end of the cylinder block 11 and the rear housing 13 is joined to the rear end of the cylinder block 11. In FIG. 1, the left side of the compressor 10 on the drawing corresponds to the front side and the right side of the compressor 10 on the drawing corresponds to the rear side. The front housing 12 has a crank chamber 14 formed therein and the rear end of the front housing 12 is closed by the cylinder block 11.

A drive shaft 15 extends through the crank chamber 14 in the vicinity thereof and is rotatably supported by the cylinder block 11 and the front housing 12. The front end of the drive shaft 15 extends out of the front housing 12 and is connected to a mechanism (not shown) which receives a power from a drive source such as an engine or a motor of a vehicle (not shown). A lug plate 16 is fixed on the drive shaft 15 in the crank chamber 14 and a swash plate 17 is mounted on the drive shaft 15 in engagement with the lug plate 16.

The swash plate 17 has at the center thereof a hole 18 through which the drive shaft 15 is inserted. The swash plate 17 has guide pins 19 which are slidably received in guide holes 20 formed in the lug plate 16, so that the swash plate 17 is connected to the lug plate 16 for rotation integrally with the drive shaft 15. Sliding motion of the guide pins 19 in the guide holes 20 allows the swash plate 17 to slide in the axial direction of the drive shaft 15 and also to be inclined relative to the drive shaft 15. A thrust bearing 21 is provided between the lug plate 16 and the front inner wall of the front housing 12, thus the lug plate 16 is rotatable relative to the front housing 12 through the thrust bearing 21.

A coil spring 22 is disposed on a part of the drive shaft 15 between the lug plate 16 and the swash plate 17, urging the swash plate 17 rearward or in the direction that decreases the inclination of the swash plate 17. It is noted that the inclination of the swash plate 17 means an angle made by a plane perpendicular to the drive shaft 15 and the plane of the swash plate 17.

The swash plate 17 has a regulating portion 17*a* projecting from the front thereof for regulating the maximum inclination angle of the swash plate 17 by contact with the lug plate 16 as shown by a chain double-dashed line in FIG. 1. A snap ring 23 is fitted on the drive shaft 15 behind the swash plate 17 and a coil spring 24 is disposed on the drive shaft 15 in front of the snap ring 23. The minimum inclination angle of the swash plate 17 is determined by the contact of the swash plate 17 with the front of the coil spring 24. In FIG. 1, the swash plate 17 indicated by a solid line is positioned at the minimum inclination angle and the swash plate 17, which is partially indicated by the chain double-dashed line, is positioned at the maximum inclination angle.

The cylinder block 11 has a plurality of cylinder bores 25 formed therein. The cylinder bores 25 are arranged around the drive shaft 15 and receive therein a single-headed piston 26 for reciprocation, respectively. Each single-headed piston 26 is engaged at the front thereof with the outer peripheral portion of the swash plate 17 through a pair of shoes 27. As the swash plate 17 is driven to rotate by the drive shaft 15, each piston 26 is moved reciprocally in its associated cylinder bore 25 by way of the shoe 27.

As shown in FIG. 1, the front end of the rear housing 13 is joined to the rear end of the cylinder block 11 through a valve plate assembly 28. A suction chamber 29 is formed in the rear housing 13 at radially inner region thereof and a discharge chamber 30 is formed in the rear housing 13 at radially outer region thereof. The suction chamber 29 and the discharge chamber 30 are communicable with a compression chamber 31 in each cylinder bore 25 through a suction port 28*a* and a discharge port 28*b* formed in the valve plate assembly 28, respectively. The suction port 28*a* and the discharge port 28*b* are provided with a suction valve 28*c* and a discharge valve 28*d*, respectively.

The compressor 10 has a displacement control valve 32 which is disposed in the rear housing 13 for changing the inclination angle of the swash plate 17 thereby to adjust the stroke of the pistons 26 and hence to control the displacement of the compressor 10. The displacement control valve 32 is arranged in a supply passage 33 which interconnects the crank chamber 14 and the discharge chamber 30 for fluid communication therebetween. A bleed passage 34 is formed in the cylinder block 11 for fluid communication between the crank chamber 14 and the suction chamber 29.

Figure 2:
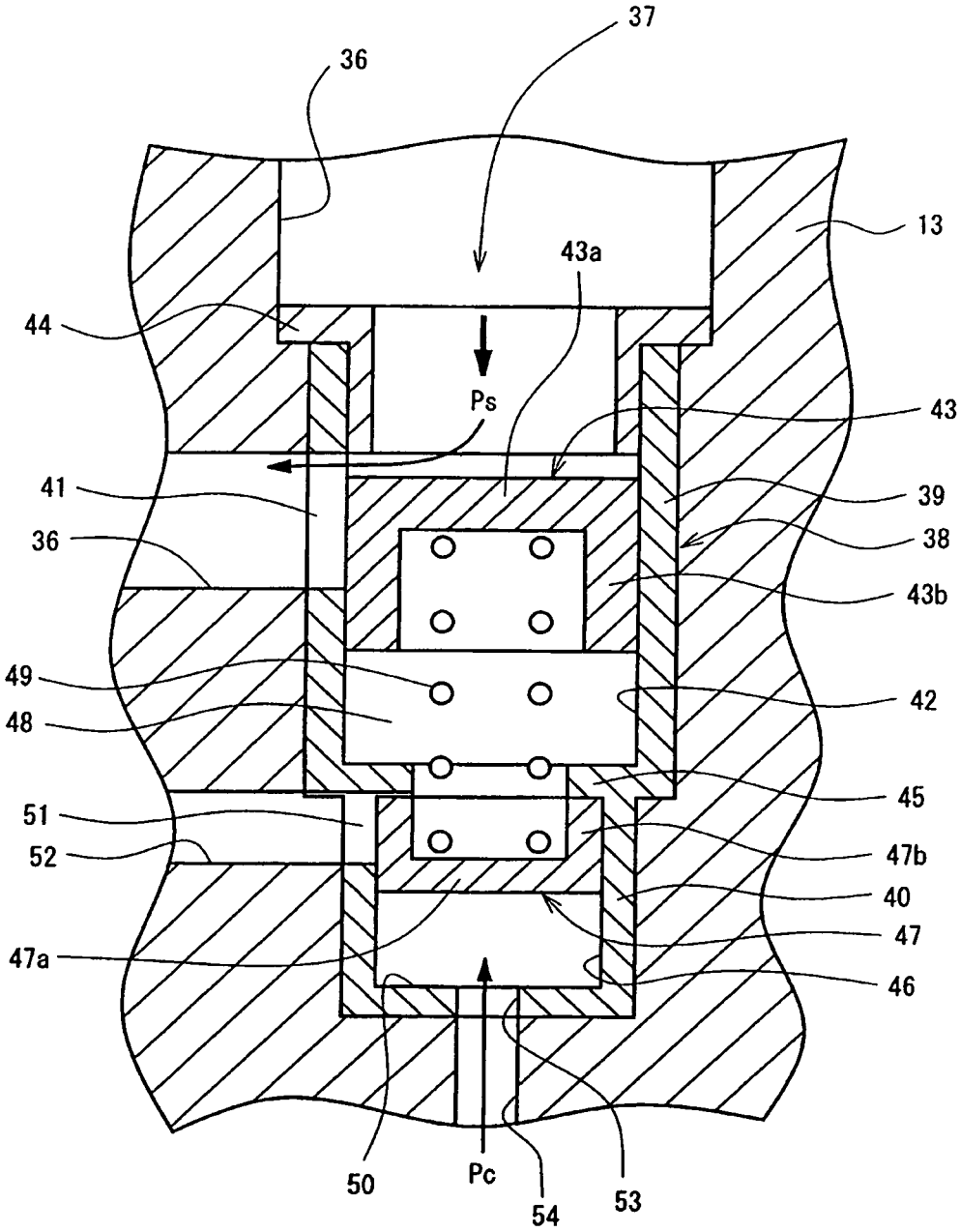
FIG. 2 is an enlarged fragmentary cross-sectional view showing a suction throttle valve of the compressor according to the first preferred embodiment of the present invention.

An inlet 35 is formed in the rear housing 13 so as to open in the rear housing 13 and communicates with the suction chamber 29 through a suction passage 36. The inlet 35 is connected to an external refrigerant circuit (not shown). A suction throttle valve 37 is disposed in the suction passage 36 for adjusting the opening area of the suction passage 36. As shown in FIG. 2, the suction throttle valve 37 has a valve housing 38 including an upper housing 39 and a lower housing 40. The upper housing includes a inner bottom surface 50 at the bottom thereof. The valve housing 38 of the suction throttle valve 37 is made of a resin material and has a cylindrical shape with a bottom. In FIG. 1 and FIG. 2, the upper side of the upper housing 39 on the drawing corresponds to the upper side of the suction throttle valve 37 and lower side of the lower housing 40 on the drawing corresponds to the lower side of the suction throttle valve 37.

The upper housing 39 has the inner diameter that is larger than the inner diameter of the lower housing 40. The upper housing 39 has a circumferential wall and a communication port 41 is formed therethrough. The communication port 41 is opened to the suction passage 36 adjacent to the suction chamber 29. The outer peripheral surface of the valve housing 38 is formed so as to correspond to the inner wall face of the suction passage 36 adjacent to the inlet 35. The communication port 41 in the upper housing 39 faces the suction passage 36 adjacent to the suction chamber 29. The upper housing 39 has a valve working chamber 42 formed therein. The valve working chamber 42 accommodates therein a cylindrical first valve body 43 for adjusting the opening area of the suction passage 36. The first valve body 43 has an outer diameter corresponding to the inner diameter of the upper housing 39 and is vertically movably arranged in the valve working chamber 42 of the upper housing 39. The first valve body 43 is moved to its lowermost position in the valve working chamber 42 when the flow rate is the maximum and is moved to the uppermost position in the valve working chamber 42 when the flow rate is the minimum, respectively. The first valve body 43 includes a disc-shaped first valve main portion 43*a* facing the inlet 35 and an annular first side wall 43*b* which seals the entire communication port 41 and extends upward from the outer peripheral portion of the first valve main portion 43*a* when the first valve body 43 is located at the uppermost position in the valve working chamber 42.

A cylindrical cap 44 whose outer diameter corresponds to the inner diameter of the upper housing 39 is fixedly inserted in the top open end of the upper housing 39. The top end of the cylindrical cap 44 is flanged and engaged with the top open end of the upper housing 39. The lower end portion of the cylindrical cap 44 is fixedly inserted in the upper housing 39 so as to determines the uppermost position of the first valve body 43. An annular projection 45 is formed between the upper housing 39 and the lower housing 40 so as to extend radially inward from the inner peripheral surface of the valve housing 38 for determining the lowermost position of the first valve body 43.

The lower housing 40 has a valve working chamber 46 formed therein for accommodating a cylindrical second valve body 47. The second valve body 47 has an outer diameter corresponding to the inner diameter of the lower housing 40 and is vertically movably arranged in the valve working chamber 46 of the lower housing 40. The valve working chamber 42 communicates with the valve working chamber 46 through a hole in the bottom of the upper housing 39. The second valve body 47 includes a disk-shaped second valve main portion 47*a* and an annular second side wall 47*b* which extends upward from the outer peripheral portion of the second valve main portion 47*a*.

A valve chamber 48 is formed in the valve housing 38 between the first valve body 43 and the second valve body 47 and a coil spring 49 as an urging member is arranged in the valve chamber 48 for urging the first valve body in the direction that decreases the opening area of the suction passage 36 or urging the first valve body 43 and the second valve body 47 away from each other. The uppermost position of the second valve body 47 is determined by the outer bottom surface of the annular projection 45 and the lowermost position of the second valve body 47 is determined by the inner bottom surface 50 of the valve housing 38 in the valve working chamber 46. Thus, the outer bottom surface of the annular projection 45 functions as a stop to restrict the upward movement of the second valve body 47. The second valve body 47 is moved to its uppermost position when the crank chamber 14 communicates with the discharge chamber 30 through the supply passage 33 or when the displacement control valve 32 is opened. When the second valve body 47 is moved to the uppermost position, the force urging the first valve body 43 upward through the coil spring 49 is increased.

Part of the circumferential wall of the upper housing 39, part of the bottom portion of the annular projection 45 and part of the circumferential wall of the lower housing 40 are cut away together to form a communication hole 51 as shown in FIG. 2. The communication hole 51 is formed to be opened to a passage 52 which communicates with the suction chamber 29. The communication hole 51 and the passage 52 are formed as a communication passage connecting the valve chamber 48 to the suction chamber 29. Accordingly, a slight clearance is made between the lower surface of the annular projection 45 and the upper surface of the annular second side wall 47*b* of the second valve body 47 adjacent to the passage 52 when the second valve body 47 is pressed in contact with the lower surface of the annular projection 45, as shown in FIG. 2. Thus, the opening area of the communication hole 51 is varied in accordance with the vertical movement of the second valve body 47 in the valve working chamber 46. When the second valve body 47 is located at the lowermost position, the opening area of the communication hole 51 is maximized or the communication hole 51 is fully opened. When the second valve body 47 is located at the uppermost position, on the other hand, the opening area of the communication hole 51 is minimized. With the second valve body 47 located at the uppermost position, the communication hole 51 is not fully closed, but a slight clearance is formed between the lower surface of the annular projection 45 and the upper surface of the annular second side wall 47*b* of the second valve body 47 adjacent to the passage 52, as shown in FIG. 2.

The bottom surface 50 of the valve housing 38 has a hole 53 formed therein and opened to a branch passage 54 which communicates with the crank chamber 14. The second valve body 47 receives the crank chamber pressure Pc transmitted through the branch passage 54 and acting on the valve working chamber 46 upward.

The following will describe the operation of the suction throttle valve 37 of the first embodiment. As the drive shaft 15 is rotated, the swash plate 17 is driven to rotate with a wobbling motion and the piston 26 connected to the swash plate 17 slides reciprocally in the cylinder bore 25, accordingly. As the piston 26 is moved frontward or leftward as seen in the drawing of FIG. 1, the refrigerant gas in the suction chamber 29 is drawn into the compression chamber 31 through the suction port 28*a* and the suction valve 28*c*. Subsequently, as the piston 26 is moved rearward or rightward as seen in the drawing of FIG. 1, refrigerant gas in the compression chamber 31 is compressed to a predetermined pressure and then discharged into the discharge chamber 30 through the discharge port 28*b* and the discharge valve 28*d*.

As the opening area of the displacement control valve 32 is changed thereby to change the crank chamber pressure Pc in the crank chamber 14, the pressure difference between the crank chamber 14 and the compression chamber 31 through the piston 26 is changed thereby to change the inclination angle of the swash plate 17. Thus, the stroke of the piston 26 and hence the displacement of the compressor 10 is adjusted. For example, as the crank chamber pressure Pc in the crank chamber 14 is lowered, the inclination angle of the swash plate 17 is increased thereby to increase the stroke of the piston 26 and hence the displacement of the compressor 10. On the other hand, as the crank chamber pressure Pc in the crank chamber 14 is raised, the inclination angle of the swash plate 17 is decreased thereby to reduce the stroke of the piston 26 and hence the displacement of the compressor 10.

Figure 3B:
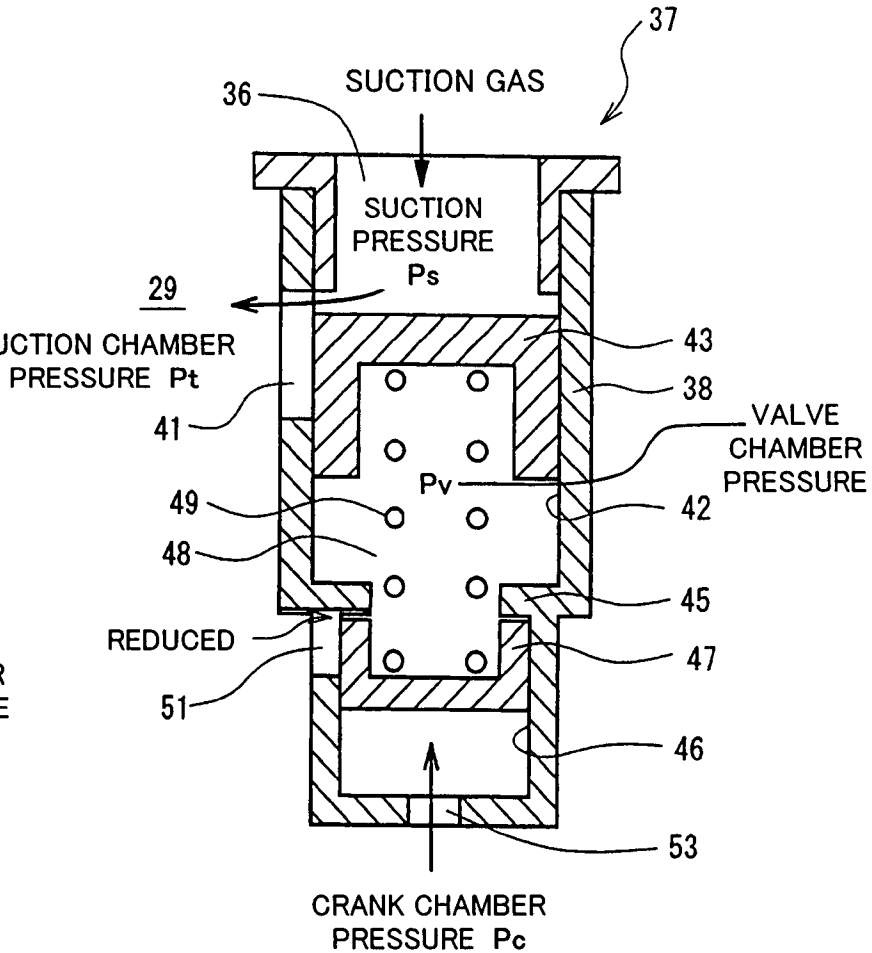
FIG. 3B is a schematic view showing the suction throttle valve during variable displacement operation of the compressor according to the first preferred embodiment of the present invention.
Figure 3A:
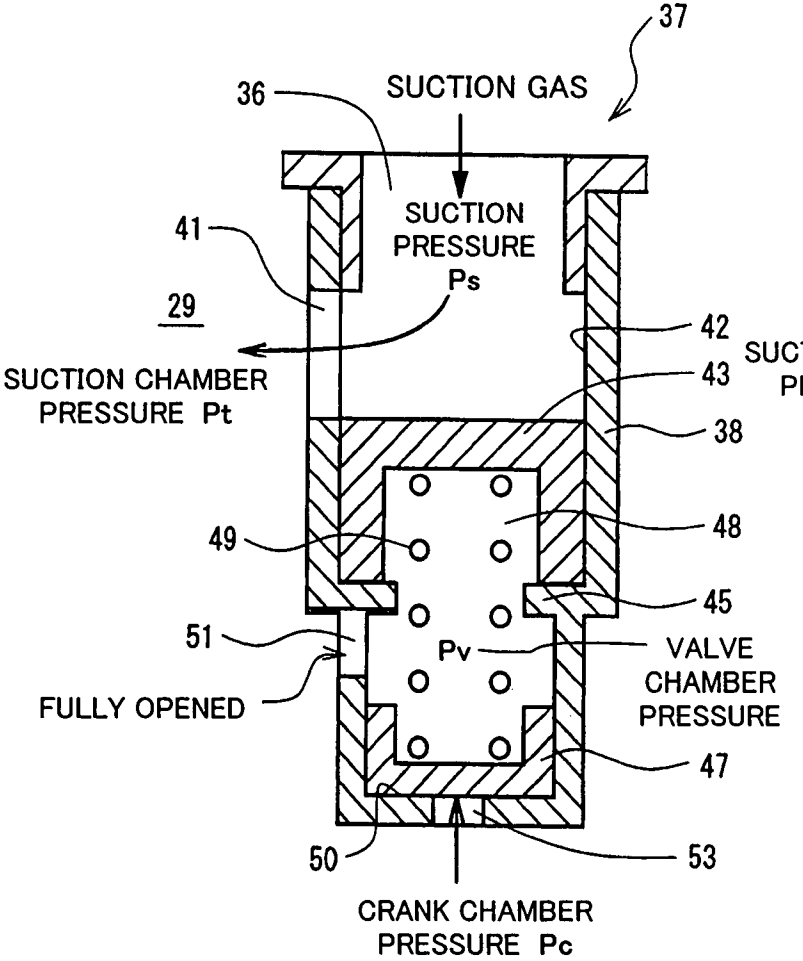
FIG. 3A is a schematic view showing the suction throttle valve during the maximum displacement operation of the compressor according to the first preferred embodiment of the present invention.

FIG. 3A shows a state of the suction throttle valve 37 when the inclination angle of the swash plate 17 is the maximum and, therefore, the compressor 10 is operating at the maximum displacement. The suction pressure of the suction gas will be designated as Ps. During the operation of the compressor 10 at the maximum displacement, the suction pressure Ps is substantially the same as the crank chamber pressure Pc, so that the second valve body 47 is moved downward and then in contact with the inner bottom surface 50 of the valve housing 38. In this state, the communication hole 51 is fully opened to communicate the valve chamber 48 with the suction chamber 29, so that the gas-tightness of the valve chamber 48 is lowered and the damper effect that is depend on the gas-tightness is minimized.

The pressure in the suction chamber 29 will be designated as Pt, and the pressure in the valve chamber 48 connected with the suction chamber 29 through the communication hole 51 and the passage 52 will be designated as Pv. When the suction refrigerant gas flows from the inlet 35 into the suction chamber 29 through the suction passage 36 with a high flow rate of the suction refrigerant gas, a pressure difference is created between the suction pressure Ps of the suction gas and the suction chamber pressure Pt. In this state, the suction pressure Ps is higher than the suction chamber pressure Pt. A pressure difference is created also between the valve chamber pressure Pv and the suction pressure Ps, since the valve chamber 48 is communicated with the suction chamber 29 though the communication hole 51 and the passage 52. The suction pressure Ps is higher than the valve chamber pressure Pv. Due to these pressure differences, the first valve body 43 is urged downward in the valve working chamber 42.

Thus, the first valve body 43 is moved downward against the urging force of the coil spring 49 acting on the first valve body 43 upward, thereby fully opening area the communication port 41. In this state, since the damper effect dependent on the gas-tightness of the valve chamber 48 becomes minimum, the factor inhibiting the downward movement of the first valve body 43 is reduced and, therefore, the first valve body 43 moves smoothly, with the result that deterioration of cooling comfort is prevented.

FIG. 3B shows a state of the suction throttle valve 37 when the inclination angle of the swash plate 17 is between the maximum and minimum angles during the intermediate displacement operation of the compressor 10. During this intermediate displacement operation of the compressor 10, the crank chamber pressure Pc is raised to exceed the suction pressure Ps. Consequently, the second valve body 47 then receiving the crank chamber pressure Pc is moved upward in the valve working chamber 46 and, therefore, the opening area of the communication hole 51 becomes reduced. Accordingly, the gas-tightness of the valve chamber 48 becomes higher and the damper effect due to such gas-tightness is increased.

When the second valve body 47 is moved upward, the first valve body 43 is urged upward through the coil spring 49 and moved to close the communication port 41 of the suction passage 36. The coil spring 49 provided between the first valve body 43 and the second valve body 47 is compressed by the pressure difference between the suction pressure Ps acting on the first valve body 43 and the crank chamber pressure Pc acting on the second valve body 47. Accordingly, the urging force of the coil spring 49 acting on the first valve body 43 is increased.

During the intermediate displacement operation of the compressor 10, the first valve body 43 is urged downward by the pressure difference between the suction pressure Ps and the valve chamber pressure Pv in the valve working chamber 42. However, the first valve body 43 is then subjected to the urging force due to the damper effect in addition to the increased urging force of the coil spring 49 and moved upward to partially close the communication port 41. This provides throttling in accordance with the flow rate of the suction refrigerant gas. Therefore, the transmission of the suction pulsation caused by self-excited vibration of the suction valve 28*c* is prevented successfully.

During operation of the compressor 10 with a low flow rate of the suction refrigerant gas, the second valve body 47 is in contact with the lower surface of the annular projection 45. In this state, the opening area of the communication hole 51 becomes minimum and the damper effect determined by the gas-tightness of the valve chamber 48 becomes maximum. The urging force of the coil spring 49 also becomes maximum to further increase the throttling effect of the opening area of the suction passage 36. Therefore, vibration and noise development caused by the suction pulsation is reduced during the operation of the compressor 10 with low flow rate of the suction refrigerant gas.

The suction throttle valve 37 of the compressor according to the first preferred embodiment has the following advantageous effects.

(1) The valve body for adjusting the opening area of the suction passage 36 includes the first valve body 43 which is movably arranged and allowed to be urged by the suction pressure Ps, and the second valve body 47 which is movably arranged and allowed to be urged by the crank chamber pressure Pc. The coil spring 49 is arranged in the valve chamber 48 and provided between the first valve body 43 and the second valve body 47. The communication hole 51 is provided to connect the valve chamber 48 and the suction chamber 29. The opening area of the communication hole 51 is variable in accordance with the vertical movement of the second valve body 47. Thus, the suction pressure Ps is substantially the same as the crank chamber pressure Pc when the compressor 10 is operated at the maximum displacement. Consequently, the second valve body 47 is moved downward and the communication hole 51 connecting the valve chamber 48 and the suction chamber 29 is fully opened. In this state, the gas-tightness of the valve chamber 48 becomes lower and the damper effect becomes minimum, accordingly. Because of the high flow rate of the suction refrigerant gas into the suction chamber 29 from the suction passage 36, the pressure difference between the suction pressure Ps and the valve chamber pressure Pv is created. Consequently, the first valve body 43 is urged downward against the urging force of the coil spring 49, moving downward in the valve working chamber 42 thereby to fully open the communication port 41. In this state, the damper effect due to the gas-tightness of the valve chamber 48 becomes minimum and, therefore, the factor inhibiting the downward movement of the first valve body 43 is reduced, with the result that the first valve body 43 moves smoothly and deterioration of cooling comfort is prevented.

(2) During the intermediate displacement operation of the compressor 10, the crank chamber pressure Pc becomes higher than the suction pressure Ps. Because of the increased crank chamber pressure Pc, the second valve body 47 is moved upward, so that the opening area of the communication hole 51 is reduced and the gas-tightness of the valve chamber 48 and hence the damping effect is increased, accordingly. Meanwhile, the urging force of the coil spring 49 acting on the first valve body 43 is increased. The first valve body 43 is then subjected to the urging force produced by the damper effect in addition to the increased urging force of the coil spring 49 and moved upward, accordingly, thereby increasing the throttling effect of the opening area of the suction passage 36. This prevents the transmission of the suction pulsation caused by the self-excited vibration of the suction valve 28*c*. Especially, during the operation of the compressor 10 with a low flow rate, the second valve body 47 is in contact with the under surface of the annular projection 45 and, therefore, the opening area of the communication hole 51 is kept at the minimum. Accordingly, the damping effect determined by the gas-tightness of the valve chamber 48 becomes maximum. Similarly, the urging force of the coil spring 49 becomes maximum thereby further increasing the throttling effect of the opening area of the suction passage 36. Therefore, vibration and noise development caused by the suction pulsation during operation of the compressor 10 with a low flow rate of the suction refrigerant gas is reduced reliably.

(3) In the first preferred embodiment, the communication hole 51 is provided for connecting the valve chamber 48 and the suction chamber 29, and the opening area of the communication hole 51 is variable in accordance with the movement of the second valve body 47, thereby effectively achieving the damping effect. Therefore, the aforementioned two requirements can be fulfilled simultaneously. In other words, the requirements are to enhance the effect of throttling the suction passage 36 during compressor operation with a low flow rate and to ensure sufficient opening area of the suction passage 36 during operation with a high flow rate. As a result, vibration and noise development caused by the suction pulsation during the operation with a low flow rate of the suction refrigerant gas is reduced and the designed performance of the compressor may be maintained over the entire range of flow rate.

(4) The communication hole 51 is provided for connecting the valve chamber 48 and the suction chamber 29 and its opening area is variable in accordance with the vertical movement of the second valve body 47. Therefore, the compressor can dispense with a driving mechanism for adjusting the opening area of the communication hole 51, thus reducing the size and the number of the parts of the compressor.

The present invention is not limited to the above first embodiment, but may be variously modified within the scope of the invention, as exemplified as follows.

In the first preferred embodiment, the valve body includes the first valve body and the second valve body. However, the valve body of an alternative embodiment may include only one valve body. In this case, the valve chamber may be formed by the valve body and the housing of the valve working chamber in which the valve body is moved vertically. A communication hole whose opening area may be variable in accordance with the movement of the valve body is provided to connect the valve chamber and the suction chamber. The provision of only one valve body simplify the structure of the suction throttle valve.

In the first preferred embodiment, the suction throttle valve is made such that the inner diameter of the upper valve housing is larger than the inner diameter of the lower valve housing and also that the outer diameter of the first valve body is larger than the outer diameter of the second valve body. However, it may be so arranged that the outer diameter of the first valve body is substantially the same as the outer diameter of the second valve body, or that the outer diameter of the first valve body is smaller than the outer diameter of the second valve body.

The coil spring is used as the urging member of the first preferred embodiment. However, the urging member may be provided in any other suitable forms such as a disk spring as long as the urging member produces such a force that the first valve body and the second valve body are urged away from each other.

Therefore, the present examples and embodiments are to be considered as illustrative and not restrictive, and the invention is not to be limited to the details given herein but may be modified within the scope of the appended claims.

What is claimed is:

1. A suction throttle valve of a variable displacement compressor having a compressor housing including a suction chamber and a crank chamber comprising:

an inlet through which suction refrigerant gas is drawn into the compressor;

a suction passage connecting the inlet to the suction chamber;

a first valve body for adjusting an opening area of the suction passage, the first valve body being movably arranged in the suction passage;

a valve housing accommodating the first valve body, wherein the valve housing has a circumferential wall formed with a communication port opened to the suction passage;

a second valve body accommodated in the valve housing;

an urging member urging the first valve body in the direction that decreases the opening area of the suction passage, the urging member provided between the first valve body and the second valve body;

a valve chamber formed in the valve housing on an opposite side of the first valve body with respect to the suction passage, the valve chamber is defined by the first valve body, the second valve body, and a part of the circumferential wall of the valve housing along which the first valve body is slidably guided; and a stop provided between the first valve body and the second valve body to restrict a movement of the second valve body;

a communication hole formed in the circumferential wall of the valve housing on an opposite side of the stop from the communication port, wherein the communication hole connects the suction chamber to the valve chamber, wherein an opening area of the communication hole is variable in accordance with the movement of the second valve body so that the opening area of the communication hole becomes maximum during the maximum displacement operation of the compressor and the opening area of the communication hole becomes reduced during the intermediate displacement operation of the compressor.

2. The suction throttle valve of the variable displacement compressor according to claim 1, wherein the first valve body is movably arranged and allowed to be urged by suction pressure and the second valve body is movably arranged and allowed to be urged by crank chamber pressure, and wherein the opening area of the communication hole is adjusted by the second valve body.

3. The suction throttle valve of the variable displacement compressor according to claim 2, wherein the first valve body includes a disk-shaped first valve main portion facing the inlet and an annular first side wall which extends downward from the outer peripheral portion of the first valve main portion, and wherein the second valve body includes a disk-shaped second valve main portion and an annular second side wall which extends upward from the outer peripheral portion of the second valve main portion.

4. The suction throttle valve of the variable displacement compressor according to claim 3, wherein the outer diameter of the first valve body is different from the outer diameter of the second valve body.

5. The suction throttle valve of the variable displacement compressor according to claim 2, wherein the valve housing includes an upper housing accommodating the first valve body and a lower housing accommodating the second valve body, wherein the stop is formed by an annular projection between the upper housing and the lower housing so as to extend radially inward from the inner peripheral surface of the valve housing, and wherein the annular projection determining the uppermost position of the second valve body.

6. The suction throttle valve of the variable displacement compressor according to claim 5, wherein a communication passage is formed by the communication hole and a passage, and wherein part of the circumferential wall of the upper housing, part of the bottom portion of the annular projection and part of the circumferential wall of the lower housing are cut away together to form the communication hole.

7. The suction throttle valve of the variable displacement compressor according to claim 1, wherein a cylindrical cap is fixedly inserted in the top open end of the valve housing, and wherein the cylindrical cap determines the uppermost position of the first valve body.

8. The suction throttle valve of the variable displacement compressor according to claim 1, wherein the first valve body is urged downward due to a pressure difference between suction pressure and valve chamber pressure during the maximum displacement operation of the compressor.

9. The suction throttle valve of the variable displacement compressor according to claim 1, further comprising a valve working chamber communicating with the crank chamber formed in the valve housing on opposite side of the second valve body with respect to the suction passage.

10. The suction throttle valve of the variable displacement compressor according to claim 9, wherein the second valve body is urged upward due to crank chamber pressure during the intermediate displacement operation of the compressor.

11. The suction throttle valve of the variable displacement compressor according to claim 1, wherein the urging member is a coil spring.

12. A variable displacement compressor comprises the suction throttle valve according to claim 1.

* * * * *